US009260950B2

(12) United States Patent
Broussard et al.

(10) Patent No.: US 9,260,950 B2
(45) Date of Patent: Feb. 16, 2016

(54) ONE TRIP TOE-TO-HEEL GRAVEL PACK AND LINER CEMENTING ASSEMBLY

(75) Inventors: John P. Broussard, Kingwood, TX (US); Christopher Hall, Cypress, TX (US); Ronald van Petegem, Montgomery, TX (US); Alvaro J. Arrazola, Houston, TX (US)

(73) Assignee: Weatherford Technologies Holdings, LLC, Houston, TX (US)

( * ) Notice: Subject to any disclaimer, the term of this patent is extended or adjusted under 35 U.S.C. 154(b) by 872 days.

(21) Appl. No.: 13/345,418

(22) Filed: Jan. 6, 2012

(65) Prior Publication Data

US 2013/0000899 A1 Jan. 3, 2013

Related U.S. Application Data

(63) Continuation-in-part of application No. 12/913,981, filed on Oct. 28, 2010, now Pat. No. 8,770,290.

(51) Int. Cl.

| | |
|---|---|
| ***E21B 43/04*** | (2006.01) |
| ***E21B 33/124*** | (2006.01) |
| ***E21B 34/10*** | (2006.01) |

(Continued)

(52) U.S. Cl.

CPC ..... *E21B 43/04* (2013.01); *E21B 33/124* (2013.01); *E21B 34/102* (2013.01); *E21B 43/08* (2013.01); *E21B 2034/007* (2013.01)

(58) Field of Classification Search

CPC ..... E21B 43/04; E21B 43/08; E21B 43/045; E21B 33/13; E21B 34/102; E21B 33/124; E21B 2034/007

USPC ..... 166/51, 278

See application file for complete search history.

(56) References Cited

U.S. PATENT DOCUMENTS

| | | | |
|---|---|---|---|
| 3,134,439 | A | 5/1964 | Shields |
| 4,105,069 | A | 8/1978 | Baker |

(Continued)

FOREIGN PATENT DOCUMENTS

| | | | |
|---|---|---|---|
| EP | 1 132 571 | A1 | 9/2001 |
| GB | 2387401 | A | 10/2003 |

(Continued)

OTHER PUBLICATIONS

First Office Action in counterpart Russian Appl. No. 2011143515, dated Nov. 26, 2012.

(Continued)

*Primary Examiner* — David Bagnell
*Assistant Examiner* — Kristyn Hall
(74) *Attorney, Agent, or Firm* — Blank Rome, LLP

(57) ABSTRACT

A gravel packing assembly gravel packs a horizontal borehole. Operators wash down the borehole using an inner string in a first position by flowing fluid from the inner string through the apparatus' toe. Operators then gravel pack by moving the inner string to one or more flow ports between a screen and the toe. Slurry flows into the borehole from the flow ports, and returns from the borehole flow through the screen. The gravel in the slurry can pack the borehole in an alpha-beta wave from toe to heel. In another condition, operators can move the inner string to a second flow port so slurry can flow into the borehole through a shunt extending from the second flow port. When gravel packing is done, operators move the inner string to a port collar in a liner of the assembly to cement the liner in the borehole.

38 Claims, 13 Drawing Sheets

(51) Int. Cl.
*E21B 43/08* (2006.01)
*E21B 34/00* (2006.01)

(56) References Cited

U.S. PATENT DOCUMENTS

| | | | | |
|---|---|---|---|---|
| 4,440,218 | A | 4/1984 | Farley | |
| 4,474,239 | A | 10/1984 | Colomb et al. | |
| 5,113,935 | A | 5/1992 | Jones et al. | |
| 5,269,375 | A | 12/1993 | Schroeder, Jr. | |
| 5,934,376 | A | 8/1999 | Nguyen et al. | |
| 6,003,600 | A | 12/1999 | Nguyen et al. | |
| 6,253,851 | B1 | 7/2001 | Schroeder, Jr. et al. | |
| 6,371,210 | B1 | 4/2002 | Bode et al. | |
| 6,446,722 | B2 | 9/2002 | Nguyen et al. | |
| 6,588,507 | B2 | 7/2003 | Dusterhoft et al. | |
| 6,601,646 | B2 | 8/2003 | Streich et al. | |
| 6,675,891 | B2 | 1/2004 | Hailey, Jr. et al. | |
| 6,749,023 | B2 | 6/2004 | Nguyen et al. | |
| 6,857,476 | B2 | 2/2005 | Richards | |
| 6,983,795 | B2 | 1/2006 | Zuklic et al. | |
| 7,017,664 | B2 | 3/2006 | Walker et al. | |
| 7,331,388 | B2 | 2/2008 | Vilela et al. | |
| 7,337,840 | B2 * | 3/2008 | Penno | 166/278 |
| 7,367,395 | B2 | 5/2008 | Vidrine et al. | |
| 7,472,750 | B2 | 1/2009 | Walker et al. | |
| 8,267,173 | B2 | 9/2012 | Clarkson et al. | |
| 2003/0000702 | A1 | 1/2003 | Streich | |
| 2003/0037925 | A1 | 2/2003 | Walker et al. | |
| 2004/0134656 | A1 | 7/2004 | Richards | |
| 2004/0211559 | A1 | 10/2004 | Nguyen et al. | |
| 2006/0076133 | A1 | 4/2006 | Penno | |
| 2007/0187095 | A1 | 8/2007 | Walker et al. | |
| 2008/0099194 | A1 | 5/2008 | Clem | |
| 2009/0095471 | A1 | 4/2009 | Guignard et al. | |
| 2009/0133875 | A1 | 5/2009 | Tibbles et al. | |
| 2010/0096130 | A1 | 4/2010 | Parlar et al. | |
| 2010/0263864 | A1 * | 10/2010 | Chay et al. | 166/278 |
| 2010/0294495 | A1 | 11/2010 | Clarkson et al. | |

FOREIGN PATENT DOCUMENTS

| | | | |
|---|---|---|---|
| RU | 1810500 | A1 | 4/1993 |
| RU | 2317404 | C1 | 2/2008 |
| RU | 2374431 | C2 | 8/2008 |
| SU | 956761 | A | 9/1982 |
| SU | 1191563 | A | 11/1985 |
| WO | 2005049954 | A2 | 6/2005 |
| WO | 2007126496 | | 11/2007 |

OTHER PUBLICATIONS

Extended Search Report received in counterpart European Appl. No. 12184724.8, dated Jan. 9, 2013.
Office Action in parent U.S. Appl. No. 12/913,981, mailed Oct. 16, 2013.
Response to Oct. 6, 2013 Office Action in parent U.S. Appl. No. 12/913,981, filed Jan. 13, 2014.
International Search Report and Written Opinion in counterpart PCT appl. PCT/US2013/020245, dated Jan. 16, 2014.
Schlumberger, "Alternate Path Screens," obtained from www.slb.com/oilfield, dated Jan. 2004, 4 pages.
Schlumberger, "FloRite—Inflow control device," obtained from www.slb.com/transcend, (c) 2009, 2 pages.
Halliburton, "Sand Control: Horizon Low Density, Lightweight Gravel," obtained from www.halliburton.com, (c) 2006, 2 pages.
Edment, Brian, et al., "Improvements in Horizontal Gravel Packing," Oilfield Review, Spring 2005, pp. 50-60.
Synopsis of SPE 38640 by Jones, L.G., et al., "Shunts Help Gravel Pack Horizontal Wellbores with Leakoff Problems," Journal of Petroleum Technology, Mar. 1998, pp. 68-69.
Coronado, Martin, et al., "Completing extended-reach, open-hole, horizontal well," obtained from http://www.offshore-mag.com/index/article-tools-template, generated on May 12, 2010, 5 pages.
Schlumberger, "ResFlow Inflow Control Devices and MudSolv Filtercake Removal Equalize Inflow and Restart Wells," obtained from www.slb.com/sandcontrol, (c) 2010, 2 pages.
Jensen, Rene, et al., "World's First Reverse-Port Uphill Openhole Gravel Pack with Swellable Packers," SPE 122765, 15 pages.
Weatherford, "Model 4P Retrievable Seal-Bore Packer Gravel-Pack System," obtained from www.weatherford.com, (c) 2005-2009, 2 pages.
Brannon, D.H., et al., "A Single-Trip, Dual-Zone Gravel Pack System Successfully Gravel Packs Green Canyon Area Wells, Gulf of Mexico," SPE 21670, (c) 1991, 7 pages.
Weatherford, "Hydraulic-Release Hookup Nipple Circulating Gravel-Pack System," obtained from www.weatherford.com, (c) 2005, 2 pages.
Weatherford, "Conventional Well Screens," obtained from www.weatherford.com, (c) 2004-2009, 16 pages.
Weatherford, "Model WFX Setting Tools," obtained from www.weatherford.com, (c) 2007-2008, 2 pages.
Weatherford, "Model WFX Crossover Tool," obtained from www.weatherford.com, (c) 2007-2008, 2 pages.
Weatherford, "Real Results: Completion Package Eliminates Sand Production, Enhances Reliability in Siberian Oil-Production Well," obtained from www.weatherford.com, (c) 2009, 1 page.
Decision on Grant in counterpart Russian Appl. No. 2011143515, dated Mar. 7, 2013.
First Office Action received in counterpart Canadian Appl. No. 2,755,623, dated Jun. 14, 2013.
First Office Action received in counterpart Australian Appl. No. 2011236063, dated May 21, 2013.
First Office Action received in counterpart U.S. Appl. No. 12/913,981, dated May 6, 2013.
Response to First Office Action received in counterpart U.S. Appl. No. 12/913,981, dated May 6, 2013.
Written Opinion in counterpart Singapore Appl. 111201403515V, mailed Mar. 16, 2015.
Decision on Grant in counterpart Russian Appl. 2014132344/03, dated Oct. 12, 2015.

* cited by examiner

ONE TRIP TOE-TO-HEEL GRAVEL PACK AND LINER CEMENTING ASSEMBLY

CROSS-REFERENCE TO RELATED APPLICATIONS

This is a continuation-in-part of U.S. application Ser. No. 12/913,981, filed 28 Oct. 2010, which is incorporated herein by reference in its entirety and to which priority is claimed.

This application is filed concurrently with U.S. patent application Ser. No. 13/345,476 and entitled "Gravel Pack Inner String Adjustment Device," U.S. patent application Ser. No. 13/345,500 and entitled "Gravel Pack Bypass Assembly," and U.S. patent application Ser. No. 13/345,544 and entitled "Gravel Pack Inner String Hydraulic Locating Device," which are also incorporated herein by reference in their entireties.

BACKGROUND

Some oil and gas wells are completed in unconsolidated formations that contain loose fines and sand. When fluids are produced from these wells, the loose fines and sand can migrate with the produced fluids and can damage equipment, such electric submersible pumps (ESP) and other systems. For this reason, completions can require screens for sand control.

Horizontal wells that require sand control are typically open hole completions. In the past, stand-alone sand screens have been used predominately in these horizontal open holes. However, operators have also been using gravel packing in these horizontal open holes to deal with sand control issues. The gravel is a specially sized particulate material, such as graded sand or proppant, which is packed around the sand screen in the annulus of the borehole. During production, the gravel acts as a filter to keep any fines and sand of the formation from migrating with produced fluids.

A prior art gravel pack assembly 20 illustrated in FIG. 1A extends from a packer 14 downhole from casing 12 in a borehole 10, which is a horizontal open hole. To control sand, operators attempt to fill the annulus between the assembly 20 and the borehole 10 with gravel (particulate material) by pumping slurry of fluid and gravel into the borehole 10 to pack the annulus. For the horizontal open borehole 10, operators can use an alpha-beta wave (or water packing) technique to pack the annulus. This technique uses a low-viscosity fluid, such as completion brine, to carry the gravel. The assembly 20 in FIG. 1A represents such an alpha-beta type.

Initially, operators position a wash pipe 40 into a screen 25 and pump the slurry of fluid and gravel down an inner string 45. The slurry passes through a port 32 in a crossover tool 30 and into the annulus between the screen 25 and the borehole 10. As shown, the crossover tool 30 positions immediately downhole from the gravel pack packer 14 and uphole from the screen 25. The crossover port 32 diverts the flow of the slurry from the inner string 45 to the annulus downhole from the packer 14. At the same time, another crossover port 34 diverts the flow of returns from the wash pipe 40 to the casing's annulus uphole from the packer 14.

As the operation commences, the slurry moves out the crossover port 32 and into the annulus. The carrying fluid in the slurry then leaks off through the formation and/or through the screen 25. However, the screen 25 prevents the gravel in the slurry from flowing into the screen 25. The fluids passing alone through the screen 25 can then return through the crossover port 34 and into the annulus above the packer 14.

As the fluid leaks off, the gravel drops out of the slurry and first packs along the low side of the borehole's annulus. The gravel collects in stages 16*a*, 16*b*, etc., which progress from the heel to the toe in what is termed an alpha wave. Because the borehole 10 is horizontal, gravitational forces dominate the formation of the alpha wave, and the gravel settles along the low side at an equilibrium height along the screen 25.

When the alpha wave of the gravel pack operation is done, the gravel then begins to collect in stages (not shown) of a beta wave. This forms along the upper side of the screen 25 starting from the toe and progressing to the heel of the screen 25. Again, the fluid carrying the gravel can pass through the screen 25 and up the wash pipe 40. To complete the beta wave, the gravel pack operation must have enough fluid velocity to maintain turbulent flow and move the gravel along the topside of the annulus. To recirculate after this point, operators have to mechanically reconfigure the crossover tool 30 to be able to washdown the pipe 40.

Although the alpha-beta technique can be economical due to the low-viscosity carrier fluid and regular types of screens that can be used, some situations may require a viscous fluid packing technique that uses an alternate path. In this technique, shunts disposed on the screen divert pumped packing slurry along the outside of the screen. FIG. 1B shows an example assembly 20 having shunts 50 and 52 (only two of which are shown). Typically, the shunts 50/52 for transport and packing are attached eccentrically to the screen 25. The transport shunts 50 feed the packing shunts 52 with slurry, and the slurry exits from nozzles 54 on the packing shunts 52. By using the shunts 50/52 to transport and pack the slurry, the gravel packing operation can avoid areas of high leak off in the borehole 10 that would tend to cause bridges to form and impair the gravel packing.

Prior art gravel pack assemblies 20 for both techniques of FIGS. 1A-1B have a number of challenges and difficulties. During a gravel pack operation in a horizontal well, for example, the crossover ports 32/34 may have to be re-configured several times. During a frac pack operation, the slurry pumped at high pressure and flow rate can sometimes dehydrate within the assembly's crossover tool 30 and associated sliding sleeve (not shown). If severe, settled sand or dehydrated slurry can stick to service tools and can even junk the well. Additionally, the crossover tool 30 is subject to erosion during frac and gravel pack operations, and the crossover tool 30 can stick in the packer 14, which can create extremely difficult fishing jobs.

To deal with gravel packing in some openhole wells, a Reverse-Port Uphill Openhole Gravel Pack system has been developed as described in SPE 122765, entitled "World's First Reverse-Port Uphill Openhole Gravel Pack with Swellable Packers" (Jensen et al. 2009). This system allows an uphill openhole to be gravel packed using a port disposed toward the toe of the hole.

Today when wells are drilled into reservoirs that are intended to be completed with an open hole gravel pack such as described above, the well is drilled to the top of the reservoir, and a liner is then set and cemented in place before drilling proceeds further into the reservoir. After the liner is run and cemented, then drilling operations can resume into the intended zone. Completing these operations in separate steps and separate pipe trips into the well adds cost and time to the overall well construction operation.

Rather than performing the cementing and gravel pack in separate steps, it would be desirable to perform these in the same run downhole. One way to do this is to run a gravel pack system downhole after drilling the hole. With the gravel pack system installed, sand slurry can be pumped through a crossover tool from the top of the targeted zone to the bottom to pack the annulus around a screen with sand. The crossover tool could then be raised past the open hole packer so that the crossover tool aligns with cementing ports. Operators can then pump cement downhole to cement the liner above the open hole packer. This requires circulating through a complicated cross-over tool.

Unfortunately, the wash pipe used for the gravel pack operation will still extend through the screen during the cementing operation. If tools are out of position, cement could be pumped into the screen, effectively ruining the operation. In addition, the cement would be pumped immediately after the gravel pack operation. Therefore, if any acidizing operation is to be subsequently performed, it would have to be through pipe that would likely have residual cement, which could damage the formation.

The subject matter of the present disclosure is directed to overcoming, or at least reducing the effects of, one or more of the problems set forth above.

SUMMARY

A gravel pack apparatus has a liner that extends from a liner hanger in a cased hole. From the liner, one or more gravel pack sections extend into an open borehole. The apparatus has a body passage disposed along its length, and various ports and screen on the apparatus can communicate fluid between the body passage and the borehole annulus. The ports include a gravel pack port, a cementing port, and a returns port, and the screen is disposed between the gravel pack port and the cementing port.

The apparatus also includes an inner string having a string passage for conveying fluids, slurry, cement, and the like to an outlet port. To perform gravel or frac pack as well as cementing operations, the inner string disposes in the body passage of the apparatus at various selective conditions. When the inner string is moved to a first selective condition in the body passage, for example, seals around the outlet port on the inner string seal at least partially with seats inside the body passage so the outlet port on the string can communicate with the gravel pack port on the body. When gravel pack slurry is pumped down the string passage, the slurry passes through the ports and into the borehole annulus to gravel pack around the screen of the apparatus.

The inner string can be moved to several conditions to gravel pack around screens of the one or more gravel pack sections. When gravel packing is completed, the apparatus is set up for cementing operations. To do this, the inner string is moved to a second selective condition so that the inner string's seals at least partially seal the outlet port with the cementing port. Cementing slurry is pumped down the string passage, and the cementing slurry fills the borehole annulus around the liner. Meanwhile, the returns port communicates fluid returns from the borehole annulus around the liner back to the body passage so the fluid returns can be conveyed uphole above the liner.

The foregoing summary is not intended to summarize each potential embodiment or every aspect of the present disclosure.

DETAILED DESCRIPTION

A. Gravel Pack/Cementing Assembly

Figure 1A:
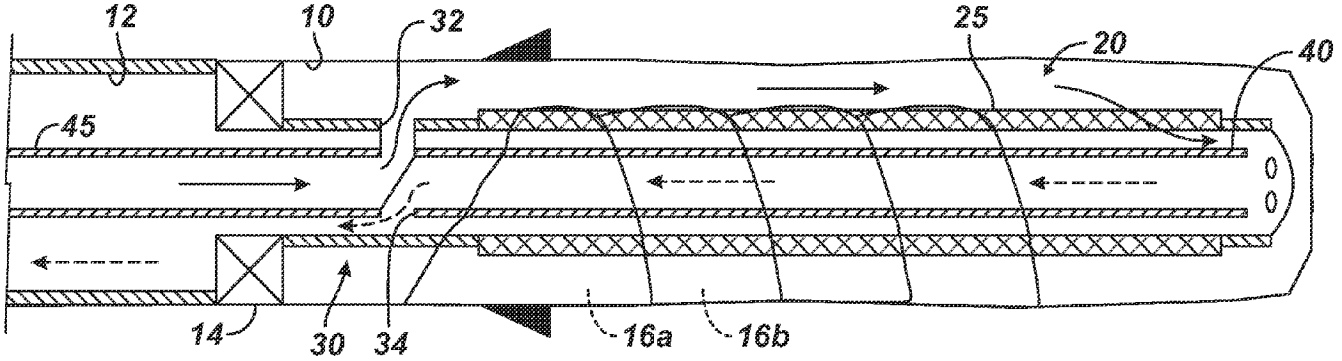
FIG. 1A (Prior Art)
FIGS. 1A-1B illustrate gravel pack assemblies according to the prior art.
Figure 1B:
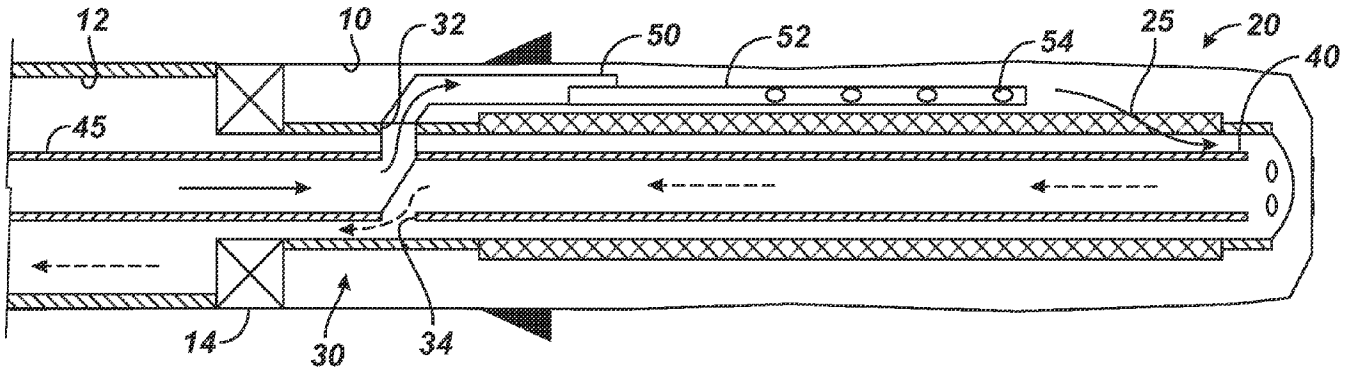
FIG. 1B (Prior Art)
Figure 2:
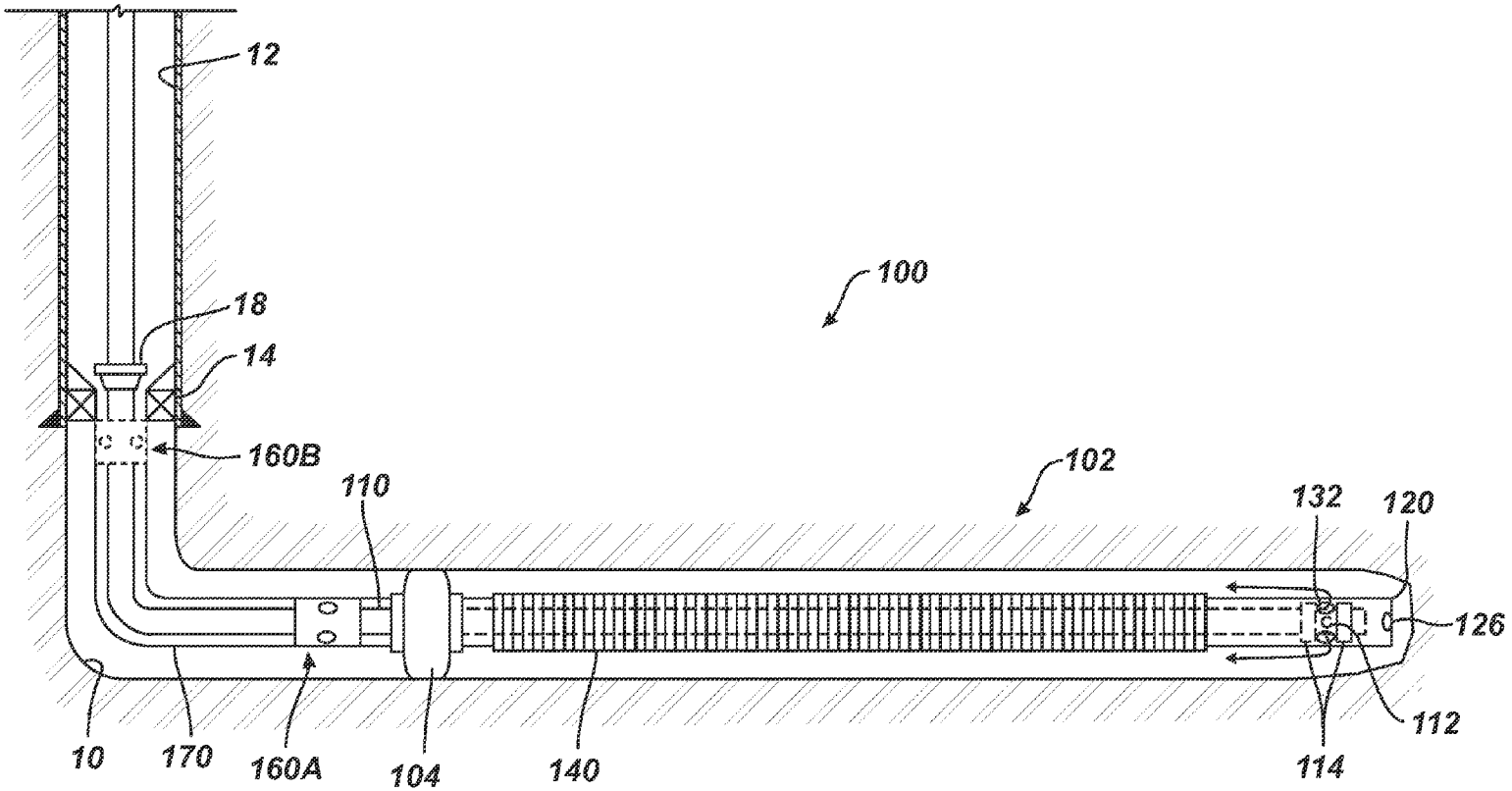
FIG. 2 shows a toe-to-heel gravel pack assembly according to the present disclosure.

FIG. 2 shows a toe-to-heel gravel pack assembly 100 having a liner 170 extending from casing 12 with a liner hanger 14. Extending further down the open borehole 10 from the liner 170, the assembly 100 has a gravel pack section 102 separated from the liner 170 by an isolating element or packer 104. The assembly 100 can be similar to one of the gravel pack assemblies disclosed in incorporated U.S. application Ser. No. 12/913,981.

The gravel pack section 102 has ports 132 and a shoe track 120 disposed downhole of a screen 140. Although one section 102 is shown, the assembly 100 can have any number of such gravel pack sections 102 in the borehole 10, and the section(s) 102 can generally have any desired length to meet the needs of the implementation.

An inner string 110 deploys in the gravel pack section 102 and performs a wash down operation through a float shoe 126 in the shoe track 120 of the assembly 100. After washdown and setting of the assembly's packer 104, the string's outlet ports 112 with its seals 114 isolate with the flow ports 132 to gravel or frac pack the gravel pack section 102. Operators pump gravel pack slurry down the inner string 110, and the slurry exits the ports 112/132. Once in the borehole 10, gravel in the slurry packs the annulus around the screen 140 in a toe-to-heel gravel packing configuration. Once gravel packing of the section 102 is completed, the inner string 110 can be moved out of the gravel pack section 102 so cementing can be performed on the liner 170 using the inner string 110 and port collars 160A-B as described later.

Figure 3:
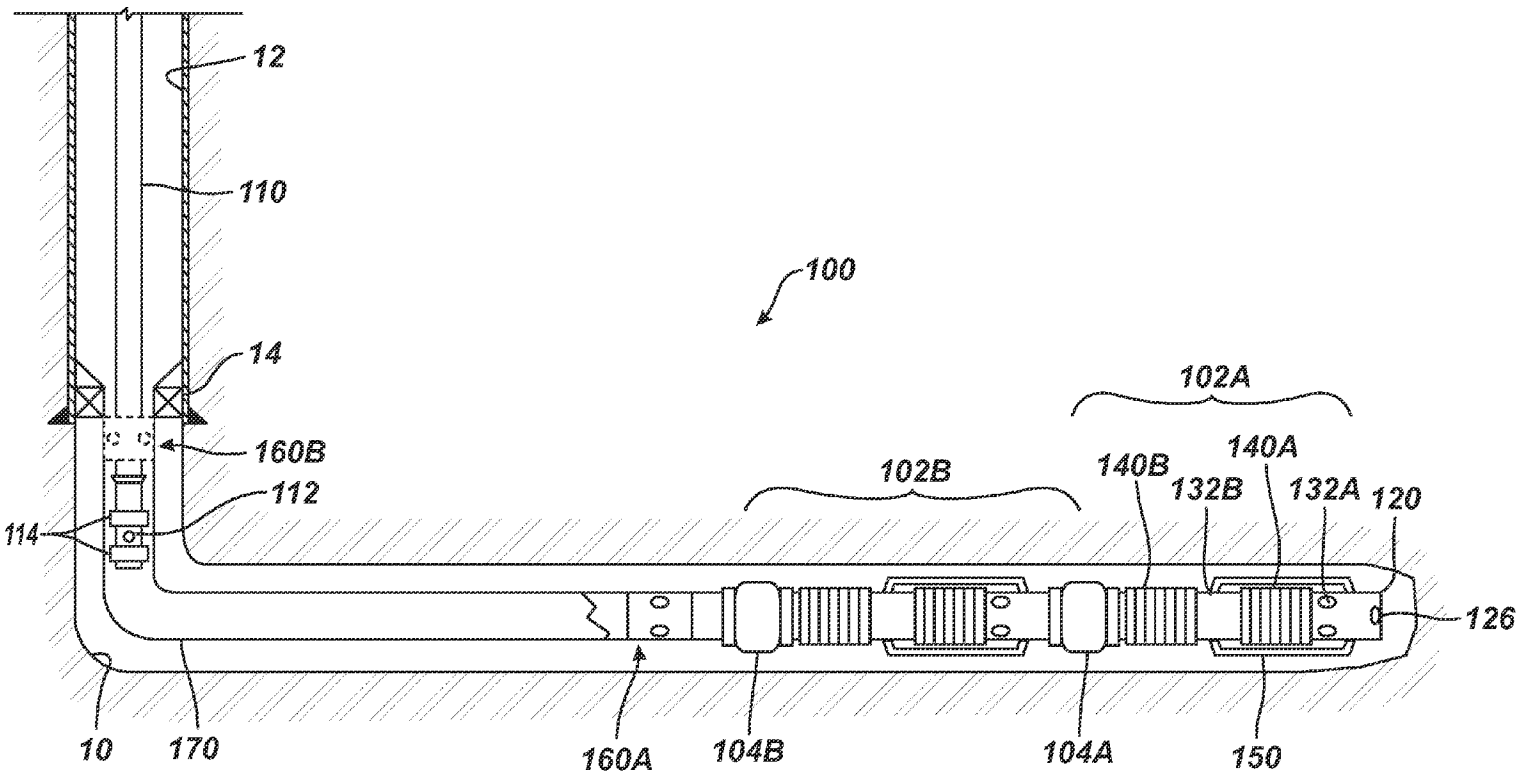
FIG. 3 shows another toe-to-heel gravel pack assembly according to the present disclosure.

FIG. 3 shows another toe-to-heel gravel pack assembly 100 having several gravel pack sections 102A-B separated from one another and separated from a liner 170 by isolating elements or packers 104A-B. Again, any number of such sections 102A-B can be used in the borehole 10, and they can generally have any desired length to meet the needs of the implementation. The depictions in the figures are only meant to be illustrative.

The isolating elements 104A-B and gravel pack sections 102A-B deploy into the well in a single trip. Having the elements 104A-B and sections 102A-B, the assembly 100 segments several compartmentalized reservoir zones so that gravel pack or frac pack operations can be performed separately on each zone. Each element 104A-B can have one or more packers to isolate the gravel pack sections 102A-B from one another and from the liner 170. Any suitable packers can be used for the elements 104A-B, hydraulic, hydrostatic, inflatable, or swellable packers. In the present disclosure, the elements 104A-B are referred to as packers for simplicity.

The assembly 100 has a hydraulic service tool (18; FIG. 2) that can make up to the liner hanger 14 to set the hanger's packer, and the assembly 100 has an inner string 110 made up to the service tool 18. Various details on how the service tool 18 is used to set the packer on the liner hanger 14 and how other steps are performed are discussed in detail in the incorporated U.S. patent application Ser. No. 12/913,981, so some of the steps are not repeated here.

Each gravel pack section 102A-B has screen sections 140A-B, ported housings 130A-B, alternate path devices or shunts 150, and other components discussed below. The screens 140A-B can use wire-wrapped screens, slotted liners, mesh screens, or any other suitable screen to filter fluid communication from the borehole annulus into the assembly 100. The ported housings 130A-B have flow ports 132A-B communicating with the borehole annulus, and the ported housings 130A-B may be disposed next to or integrated into the screen sections 140A-B. Overall, the screen sections 140A-B and the ported housings 130A-B provide slurry packing points for gravel packing operations as disclosed below.

As shown, the flow ports 132B on the uphole ported housings 130B can communicate with the alternate path devices 150 disposed along the length of the lower screen section 140A. These alternate path devices 150 can be shunts, tubes, concentrically mounted tubing, or other devices known in the art for providing an alternate path for slurry. For the purposes of the present disclosure, however, the alternate path devices 150 are referred to as shunts for simplicity. In general, the shunts 150 communicate from the flow ports 132B to shunt ports toward the distal end of the assembly 100, but the shunts 150 can direct the flow in other directions.

Uphole of the sections 102A-B, the assembly 100 has the liner 170 supported by the liner hanger 14 from the casing 12, and the liner 170 has the port collars 160A-B for the cementing operations. The port collars 160A-B can use any of the available port collars known and used in the art. In general, the port collars 160A-B can remain constantly open, or they can be selectively opened and closed as needed. For example, the port collars 160A-B can have mechanically actuated sliding or rotated sleeves, which can be opened and closed with an appropriate shifting tool. U.S. Pat. No. 6,513,595, which is incorporated herein by reference in its entirety, discloses one particular example of a port collar that can be used in the disclosed assembly 100. The port collars 160A-B could also be stage tools that are hydraulically opened.

Although the assembly 100 of FIG. 3 is similar to one of the gravel pack assemblies disclosed in incorporated U.S. application Ser. No. 12/913,981. Another assembly disclosed in FIGS. 2A-2C of the incorporated U.S. application Ser. No. 12/913,981 could also be used. This other assembly has an open distal end on the inner string that allows slurry and fluid to flow therethrough. Accordingly, after gravel packing is complete, fluid flow through this distal end must be closed off before cementing can be performed. This can be done by closing a valve, seating a ball, or otherwise closing off fluid communication through the distal end so that cement can be properly diverted to the port collar 160A.

Figure 4A:
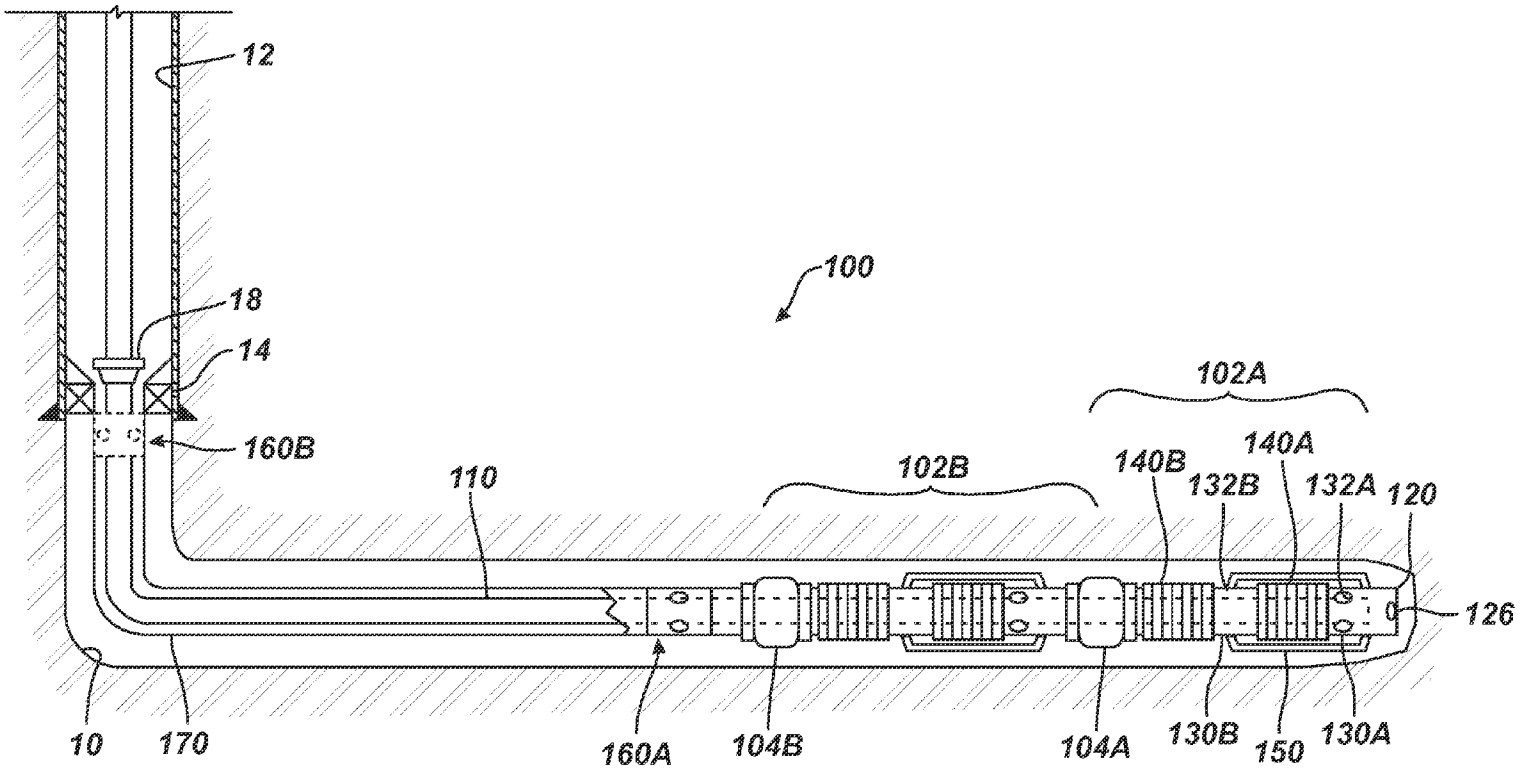
FIGS. 4A-4B show the gravel pack assembly of FIG. 3 in stages of operation, including washdown and gravel packing.
Figure 4B:
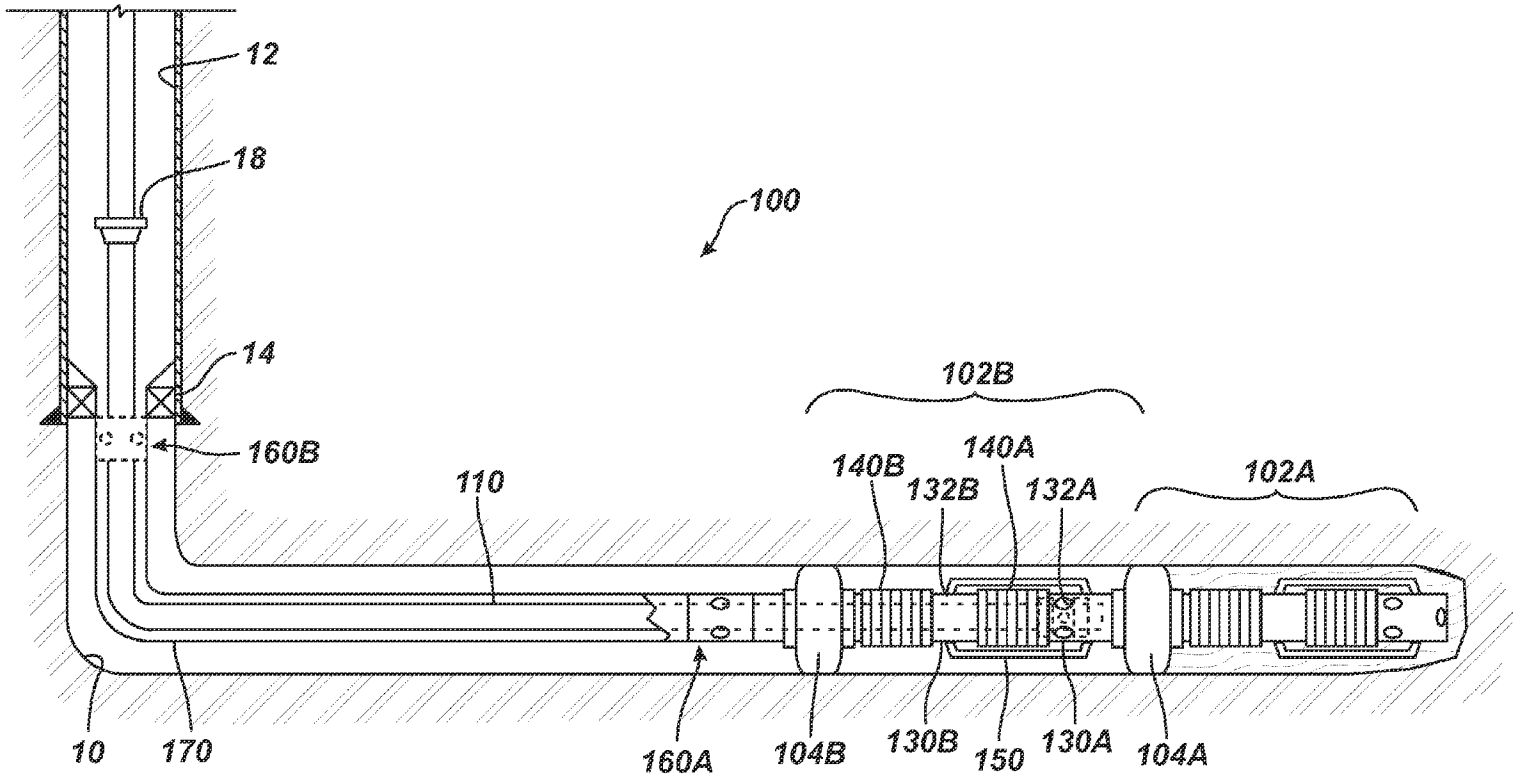
Figure 4D:
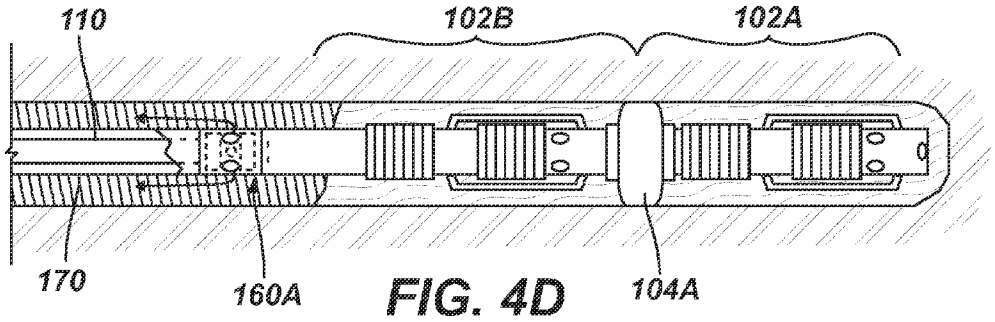
FIG. 4D shows the gravel pack assembly of FIG. 3 lacking an uphole packing element as an alternative arrangement.
Figure 4C:
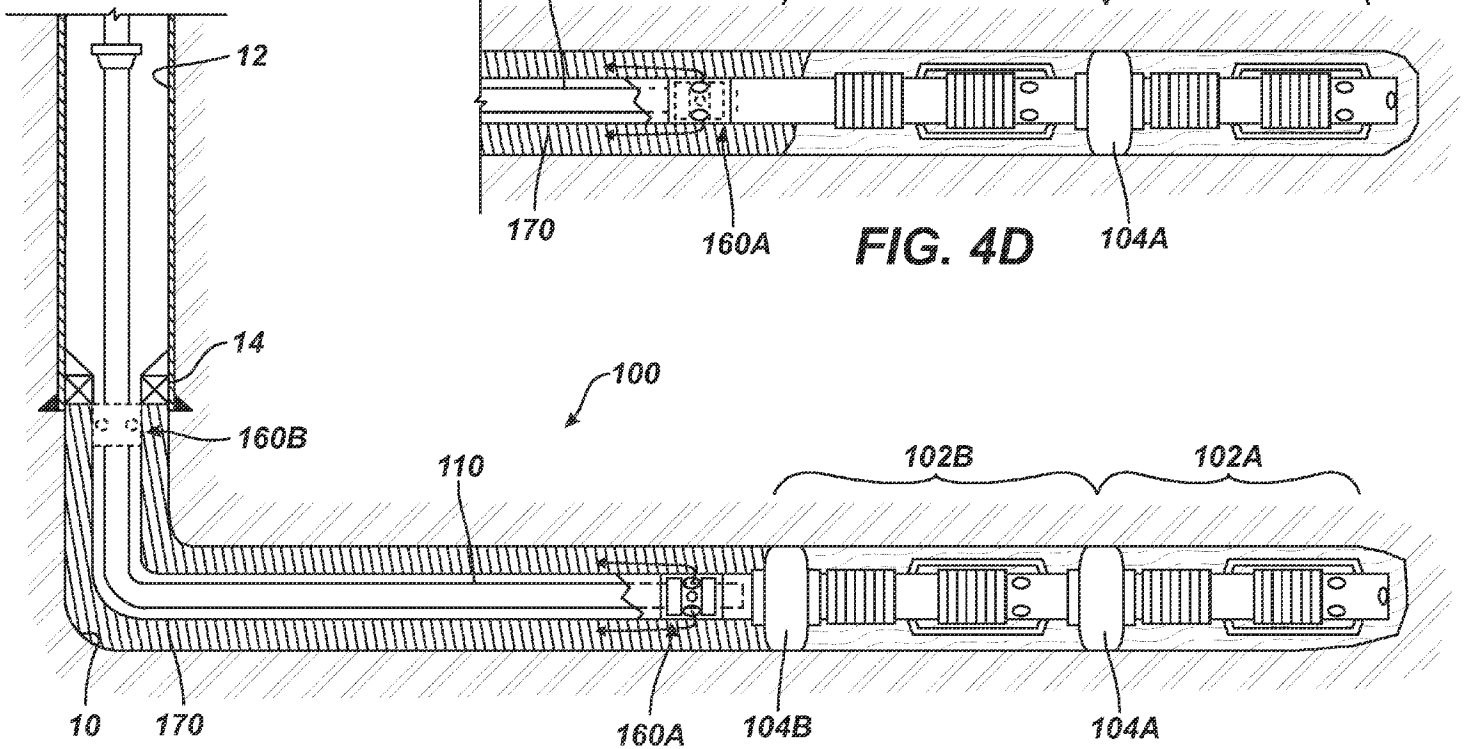
FIG. 4C shows the gravel pack assembly of FIG. 3 in a stage of cementing.

With a general understanding of the assembly 100 of FIG. 3, discussion turns to FIGS. 4A-4D, which show the gravel pack assembly 100 during stages of operation. FIGS. 4A, 4B, and 4C respectively show the gravel pack assembly 100 during a washdown operation, a gravel pack operation, and a cementing operation. Each of these will be discussed in turn.

Looking first at the washdown operation in FIG. 4A, the inner string 110 extending from the service tool 18 disposes through the sections 102A-B of the assembly 100. The inner string 110 installs in the shoe track 120 so that the string's outlet ports 112 can communicate with a float shoe 126 at the end of the track 120. Operators pump washdown fluid down the inner string 110, and the washdown fluid flows out the float shoe 126. The washdown fluid then travels uphole in the annulus of the borehole 10 and out the liner hanger 14, whose packer remains unset at this stage.

After washdown, operations proceed to gravel packing as shown in FIG. 4B. Initially, the packers 104A-B are set using procedures known in the art. The packer on the liner hanger 14 may also be set for the gravel packing operations.

To begin gravel packing, the inner string 110 is positioned and sealed in selective positions in the assembly's ported housings 130A-B. In a first stage, for example, the ports 112 and seals 114 of the inner string 112 are manipulated in the first gravel pack section 102A, and slurry is then pumped down the inner string 110 so the first section 102A can be packed with a toe-to-heel packing configuration discussed herein. After this, the inner string 110 can be moved to the next gravel pack section 102B as shown in FIG. 4B to proceed with gravel packing this section 102B in a similar fashion. The same procedure can repeated along the assembly's length for the various isolated sections 102.

In the arrangement of each section 102A-B, the flow ports 132A in the lower ported housing 130A can divert the slurry directly into the borehole annulus, while the flow ports 132B in the upper ported housing 130B direct the slurry into the shunts 150. Other arrangements can be used. In any event, the selective positioning and sealing between the string 110 and the housings 130A-B changes fluid paths for the delivery of slurry into the borehole annulus around the screen sections 140A-B in each section 102A-B during the gravel pack operations.

After the gravel pack operations, the inner string 110 is then raised to the cementing port collar 160A disposed on the liner 170 uphole of the gravel pack sections 102A-B as shown in FIG. 4C. Operators manipulate the ports 112 and seals 114 on the inner string 110 in the lower collar 160A (as described in more detail below) and commence pumping cementing slurry down the inner string 110. The cementing slurry exits the ports 112 and the collar 160A, and the cement slurry begins filling the annulus of the borehole 10 around the liner 170 from the downhole packer 104B to the uphole liner hanger 14. In the current implementation, the liner hanger 14 can have a set packer isolating the borehole annulus from the casing 12. Therefore, the other port collar 160B uphole on the liner 170 can allow fluid returns from the annulus to flow back into the liner 170 and the uphole to the casing 12.

At the end of cementing operations, operators clean out any excess cement or the like that may have entered the liner 170 through the uphole port collar 160B, for example. To do this cleaning, operators can circulate fluid through the assembly 100. At the end of cementing and cleaning, the inner string 110 can eventually be removed from the assembly 100 so production operations can commence.

When manipulating the inner string 110 between the different stages of operation, operators are preferably given an indication at the surface that the outlet ports 112 are located at an intended position, whether it is a slurry circulating position (i.e., at flow ports 132A), a blank position, or an evacuating position. One way to accomplish this indication involves measuring tension or compression on the workstring at the surface to determine the position of the inner string 110 relative to the ported housings 130A-B and seats 134. This and other procedures known in the art can be used.

As a final note, the uphole gravel pack section 102B in FIG. 4C is separated from the liner 170 by an uppermost packer 104B. When cementing is performed, the cement exiting the port collar 160A is held back by this uppermost packer 104B. Although useful, the packer 104B may be optional in some implementations. For example, FIG. 4D shows the assembly 100 without such an uphole packer. Instead, the cement is allowed to interface with the packed gravel in the uphole gravel pack section 102B.

B. Gravel Packing Operation

Having a general overview of the gravel pack assembly 100 and its stages of operations to gravel pack and cement in the borehole, discussion now turns to more detailed explanations of the assembly 100.

Figure 5A:
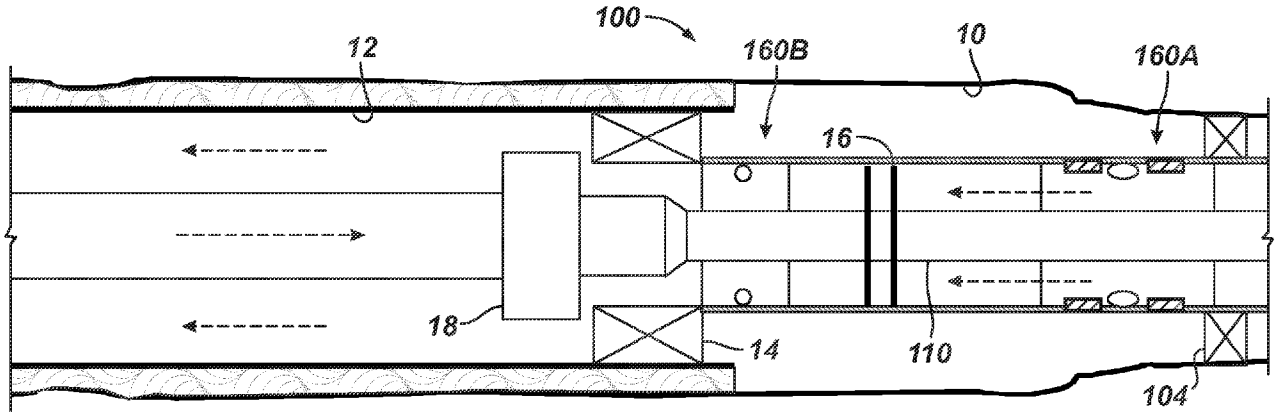
FIGS. 5A-5B show portions of the gravel pack assembly of FIG. 3 in more detail during washdown.
Figure 5B:
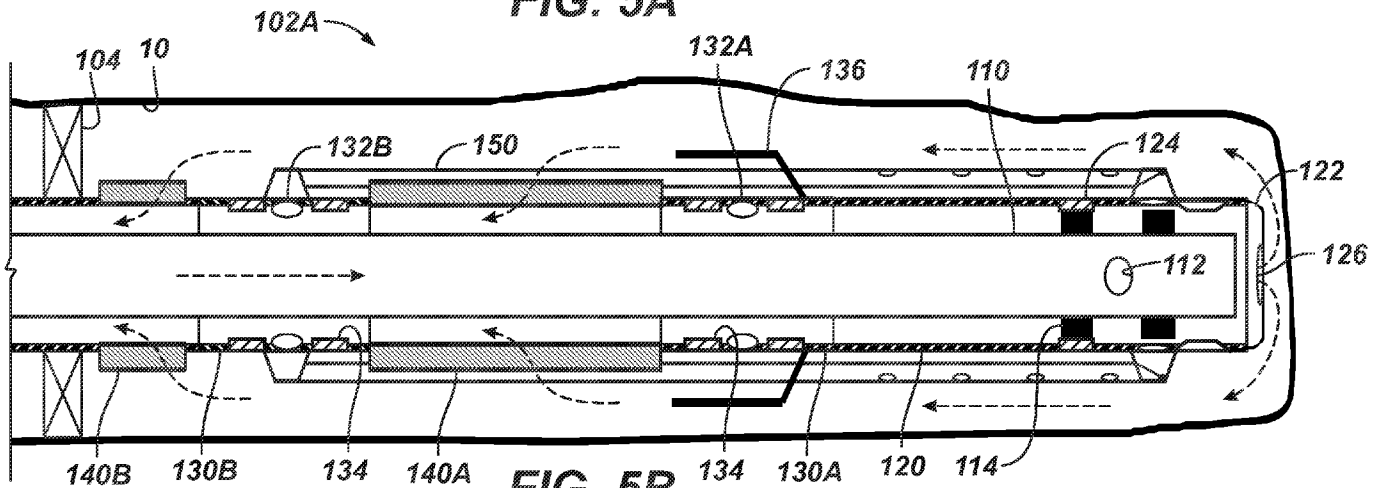

Turning first to FIGS. 5A-5B, portions of the gravel pack assembly 100 are shown in greater detail during a washdown operation. As detailed previously and shown again in FIG. 5A, the gravel pack assembly 100 includes the liner 170 that extends into the borehole 10 from the liner hanger 14 in the casing 12. The cementing port collar 160A is disposed on the liner 170 uphole of the uppermost packer 104, which isolates the sections 102A-B to be gravel packed from the liner 170. The other port collar 160B disposed on the liner 170 near the liner hanger 14 allows for returns during the cementing operations. Further details of these collars 160A-B and the cementing operation are provided below with reference to FIGS. 9A through 11B.

As before, the assembly 100 can having several gravel pack sections, although FIG. 5B only shows the distal section 102A. As also discussed previously, the section 102A has the screen sections 140A-B, the ported housings 130A-B, and the alternate path devices 150 disposed along its length. Each of the ported housings 130A-B has its flow ports 132A-B for diverting flow, and each of the ported housings 130A-B has the seats 134 defined above and below the outlet ports 132A-B for sealing with the seals 114 on the inner string 110.

To prevent erosion, the flow ports 132A on the lower housing 130A can have a skirt 136 to direct the flow of slurry. By contrast, the flow ports 132B on the uphole housing 130B communicate with the alternate path devices 150 disposed along the length of the lower screen section 140A. As note above, these alternate path devices 150 can be shunts, tubes, concentrically mounted tubing, or other devices known in the art for providing an alternate path for slurry. Moreover, the shunts 150 communicate flow from the flow ports 132B toward the distal end of the assembly 100, although they could direct flow in other directions.

As shown in FIGS. 5A-5B, the assembly 100 is run-in hole for the washdown operation. As best shown in FIG. 5A, the service tool 18 sits on the liner hanger 14, which can have an unset packer, and seals 16 on the service tool 18 do not seal in the liner hanger 14. In this way, hydrostatic pressure can be transmitted past the seals 16.

As shown in FIG. 5B, the inner string 110 extending from the service tool 18 (FIG. 5A) disposes through the screen sections 140A-B of the assembly 100. (The inner string 110 can have a reverse taper to reduce circulating pressures if desired.) On the end of the screen sections 140A-B, the assembly 100 has the shoe track 120 with the float shoe 126 and a seat 124. The float shoe 126 has a check valve, sleeve, or the like (not shown) that allows for washing down or circulating fluid around the outside the screen sections 140A-B when running in the well and before the packer 14 is set.

On its distal end, the inner string 110 has the outlet ports 112 isolated by the seals 114. When run in for washdown, one of the string's seals 114 as shown in FIG. 5B engages the seat 124 inside the shoe track 120 near the float shoe 126. With the string 110 set in this position, operators pump washdown fluid down the inner string 110, and the circulated fluid flows out the check valve in the float shoe 126, up the annulus, and around the unset packer of the liner hanger 14.

Figure 6A:
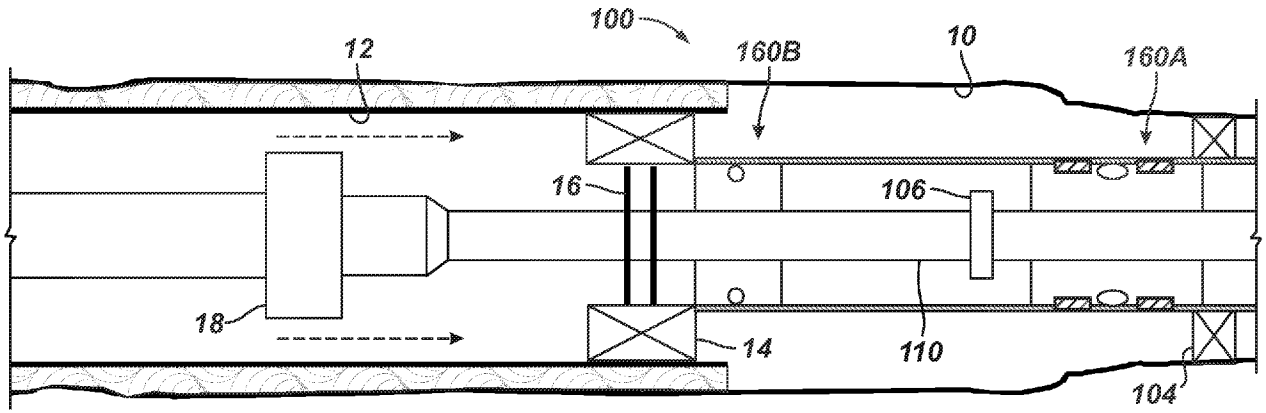
FIGS. 6A-6B show portions of the gravel pack assembly of FIG. 3 in more detail during setting and testing of a packer on a liner hanger.
Figure 6B:
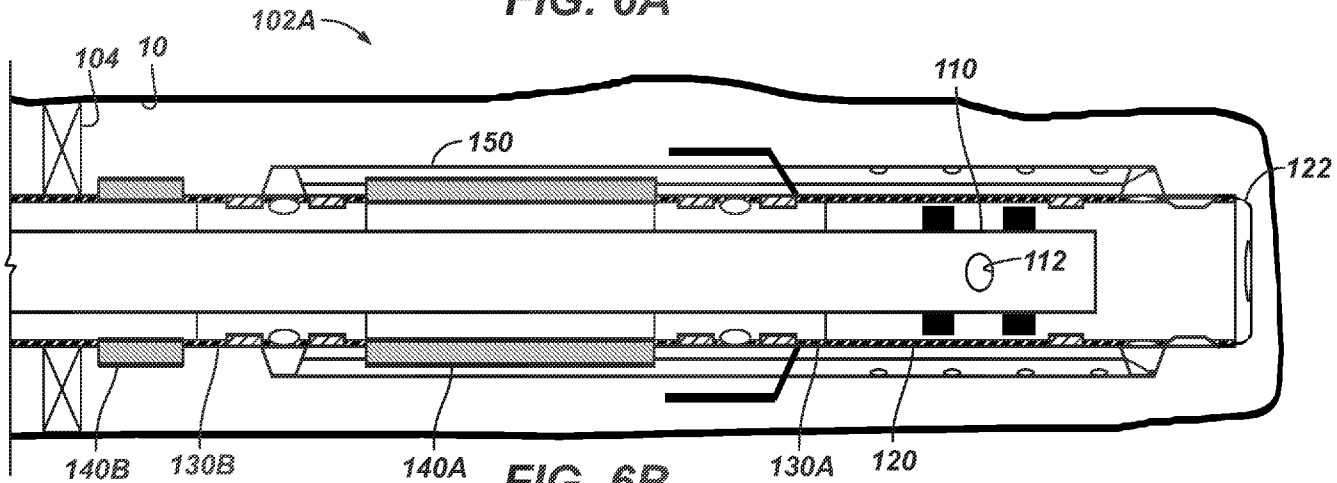

After washdown, operators then set and test the packer on the liner hanger 14 as shown in FIGS. 6A-6B. To set the hanger's packer, operators pump fluid downhole to hydraulically or hydrostatically set the packer on the hanger 14 using procedures well known in the art, although other packer setting techniques can be used. A packer setting tool 106 disposed on the inner string 110 can be used for this purpose and can be any suitable tool known in the art for hydraulically or hydrostatically setting a packer. The setting tool 106 can also be used to set other packers of the assembly 100, although the various packers can be set in any number of ways known in the art.

To test the packer on the hanger 14 once set, the seal 16 on the service tool 18 is raised into the hanger's bore as shown in FIG. 6A after releasing from the liner hanger 14. Operators then test the packer on the hanger 14 by pressuring up the casing 12. Fluid passing through any pressure leak at the hanger 14 will go into formation around the screen sections 140A-B. In addition, any leaking fluid will pass into the inner string's outlet ports 112 and up to the surface through the inner string 110. Regardless, the assembly 100 allows operators to maintain hydrostatic pressure on the formation during these various stages of operation.

Figure 7A:
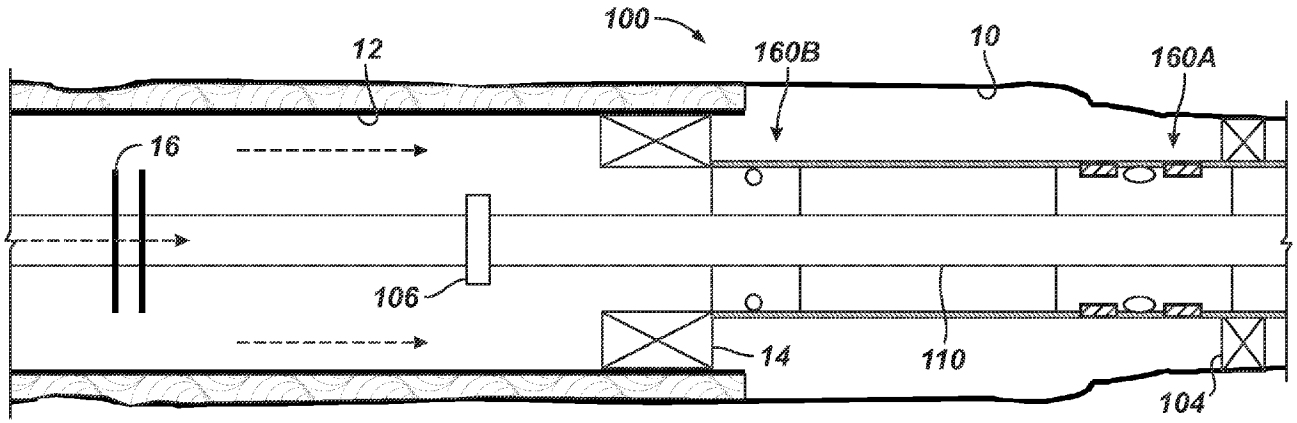
FIGS. 7A-7B show portions of the gravel pack assembly of FIG. 3 in more detail during a first part of gravel pack operations.
Figure 7B:
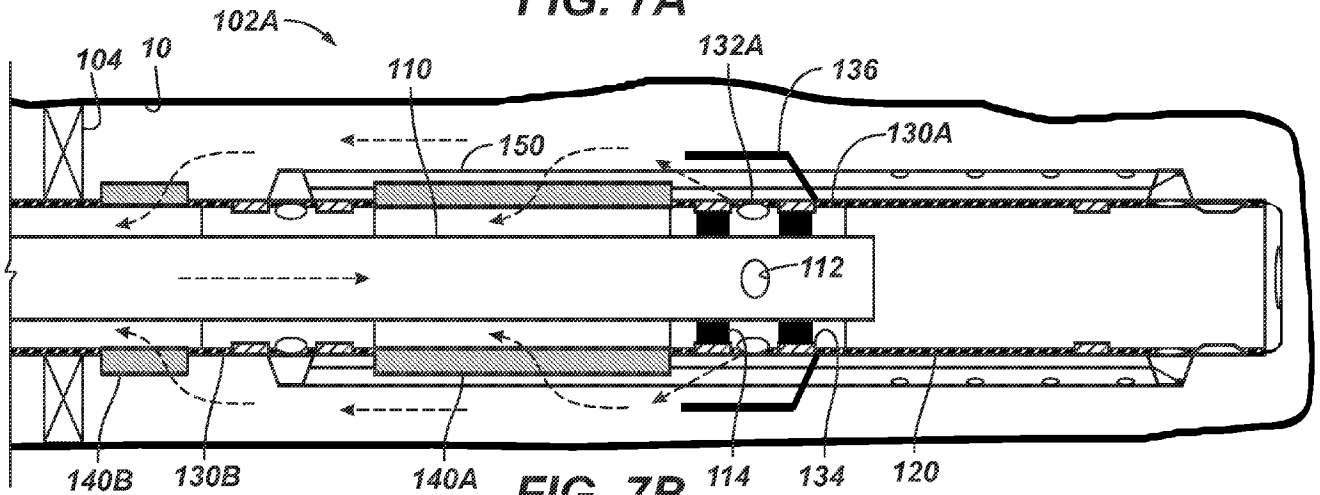

Once the packer of the hanger 14 is set and tested, operators begin the gravel pack operation. As shown in FIGS. 7A-7B, operators raise the inner string 110 to locate in a first gravel pack position. In particular, the string's seals 114 for the outlet ports 112 seal inside the seats 134 on the lower housing 130A. When this is done, the string's ports 112 communicate with the housing's ports 132A, and the seals 114 isolate the fluid communication between them. The seals 114 can use elastomeric or other types of seals disposed on the inner string 110, and the seats 134 can be polished seats or surfaces inside the housings 130A-B to engage the seals 114. Although shown with this configuration, the reverse arrangement can be used with seals on the inside of the housings 130A-B and with seats on the inner string 110.

With the ports 112/132A isolated by the engaged seals 114 and seats 134, operators pump the gravel pack slurry of carrying fluid and gravel down the inner string 110 in a first direction to the string's ports 112. The slurry passes out of the string's outlet ports 112 and through the housing's ports 132A to the borehole annulus. In the toe-to-heel gravel packing, the carrying fluid in the slurry then leaks off through the formation and/or through the screen sections 140A-B along the length of the assembly 100. However, the screen sections 140A-B prevent the gravel in the slurry from flowing into the assembly 100. Therefore, the fluid passes alone through the screen sections 140A-B and returns through the casing annulus above the packer on the liner hanger In the toe-to-heel configuration described herein, the gravel can pack the borehole annulus in an alpha-beta wave, although other variations can be used. As the fluid leaks off, for example, the gravel drops out of the slurry and first packs along the low side of the annulus in the borehole 10. The gravel collects in stages that progress from the toe (near the housing 130A) to the heel (near the packer 104) in an alpha wave. Gravitational forces dominate the formation of the alpha wave, and the gravel settles along the low side at an equilibrium height along the screen sections 140A-B. After the alpha wave, the borehole 10 then fills in a beta wave along the assembly 100, filling from the heel (near the packer 104) to the toe (near the housing 130A) along the upper side of the borehole annulus.

Figure 8A:
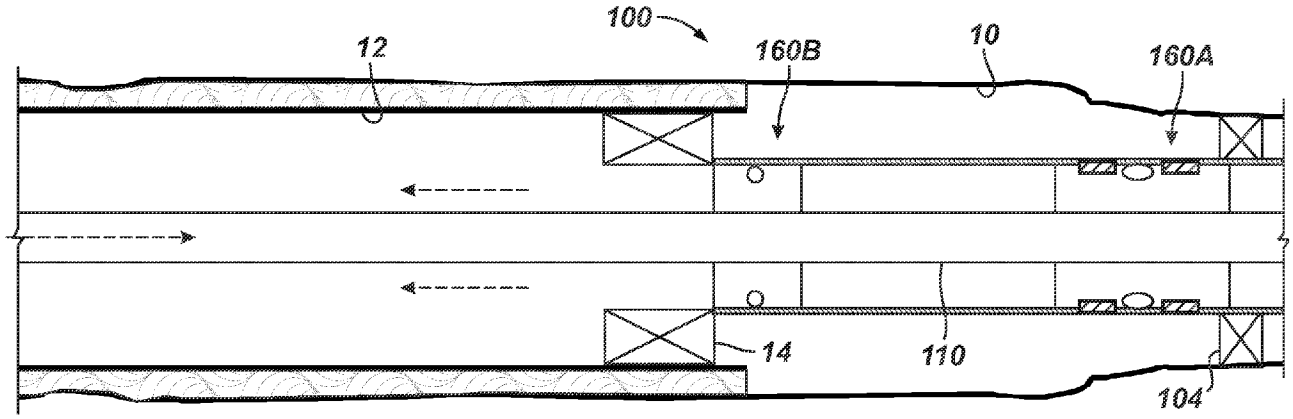
FIGS. 8A-8B show portions of the gravel pack assembly of FIG. 3 in more detail during a second part of the gravel pack operations.
Figure 8B:
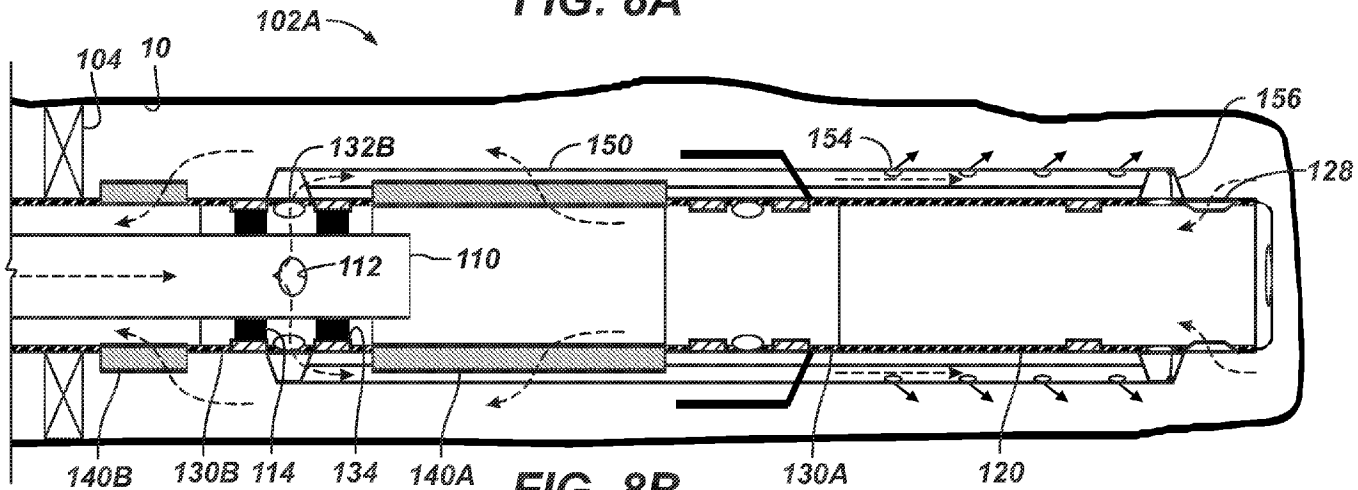

Eventually, the operators reach a desired state while pumping the slurry at the ports 132A in this lower housing 130A. This desired state can be determined by a particular rise in the pressure levels and may be termed as "sand out" in some contexts. At this point, operators raise the inner string 110 again as shown in FIGS. 8A-8B. The seals 114 now engage the seats 134 around the flow ports 132B on the next ported housing 130B between the screen sections 140A-B. Operators pump slurry down the inner string 110 again in the first direction to the outlet ports 112, and the slurry flows from the outlet ports 112 and through the housing's flow ports 132B.

In general, the slurry can flow out of the flow ports 132B and into the surrounding annulus if desired. This is possible if one or more of the flow ports 132B communicate directly with the borehole annulus and do not communicate with one of the shunt 150. All the same, the slurry can flow out of the ports 132B and into the shunts 150 for placement elsewhere in the surrounding annulus. Although the shunts 150 are depicted in a certain way, any desirable arrangement and number of transport and packing devices for an alternate path can be used to feed and deliver the slurry.

Depending on the implementation, this second stage of pumping slurry may be used to further gravel pack the borehole 10. Yet, as shown in the current implementation, pumping the slurry through the shunts 150 enables operators to evacuate excess slurry from the string 110 to the borehole 10 without reversing flow in the string 110 from the first flow direction (i.e., toward the string's ports 112). This is in contrast to the reverse direction of flowing fluid down the annulus between the string 110 and the housings 130A-B/screens 140A-B to evacuate excess slurry from the string 110.

As shown in FIG. 8B, the slurry travels from the outlet ports 112, through the flow ports 132B, and through the shunts 150. From the shunts 150, the slurry then passes out the side ports or nozzles 154 in the shunts 150 and fills the annulus around shoe track 120. This provides the gravel packing operation with an alternate path to gravel pack the borehole 10 different from the assembly's primary toe-to-heel path. In this way, the shunts 150 attached to the ported housing 130B above the lower screen section 140A can be used to gravel pack the end of the borehole 10 and/or dispose of excess gravel from the inner string 110 around the shoe track 120.

The shunts 150 carry the slurry down the lower screen section 140A so a wash pipe is not needed at the end of the section 140A. However, a bypass 128 defined in a downhole location of the shoe track 120 allows for returns of fluid during this process. This bypass 128 can be a check valve, a screen portion, a sleeve, or other suitable device that allows the returns (and not gravel) from the borehole 10 to enter the assembly 100. In fact, the bypass 128 as a screen portion can have any desirable length along the shoe track 120 depending on the implementation.

As fluid returns enters the assembly 100 through the bypass 128, the fluid returns can pass out the lower screen section 140A, through the packed gravel, and back through upper screen section 140B to travel uphole. In other arrangements, the lower ported housing 130A can have a bypass, another shunt, or the like (not shown), which can be used to deliver fluid returns past the seals 114 and seats 134 and uphole.

At some point, operation may reach a "sand out" condition or a pressure increase while pumping slurry at these upper flow ports 132B. At this point, a valve, rupture disc, or other closure device 156 in the shunts 150 can open so the gravel in the slurry can then fill inside the shoe track 120 after evacuating the excess around the shoe track 120. In this way, operators can evacuate excess gravel inside the shoe track 120.

Figure 9A:
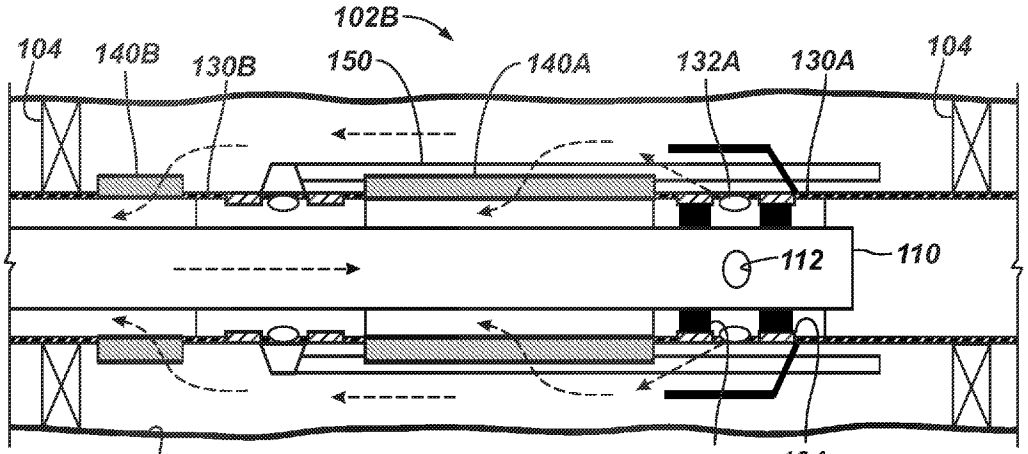
FIGS. 9A-9B show additional sections of the gravel pack assembly during stages of gravel packing.

After gravel packing the first section 102A as discussed above, operators raise the inner string 110 to the next section (i.e., 102B) to be gravel packed. As shown in FIG. 9A, this next section 102B disposed further uphole can be essentially the same as the previous section 102A. Thus, the second section 102B can have the ported housings 130A-B, the screen sections 140A-B, and the shunt tubes 150 just as before. Rather than exiting excess slurry into the assembly 100 during sand disposal, the shunts 150 as shown in FIG. 9A may terminate at the downhole end of the section 102B to deposit sand in this area during gravel packing. Much of the other steps for gravel packing the section 102B would be the same as discussed previously.

Figure 9B:
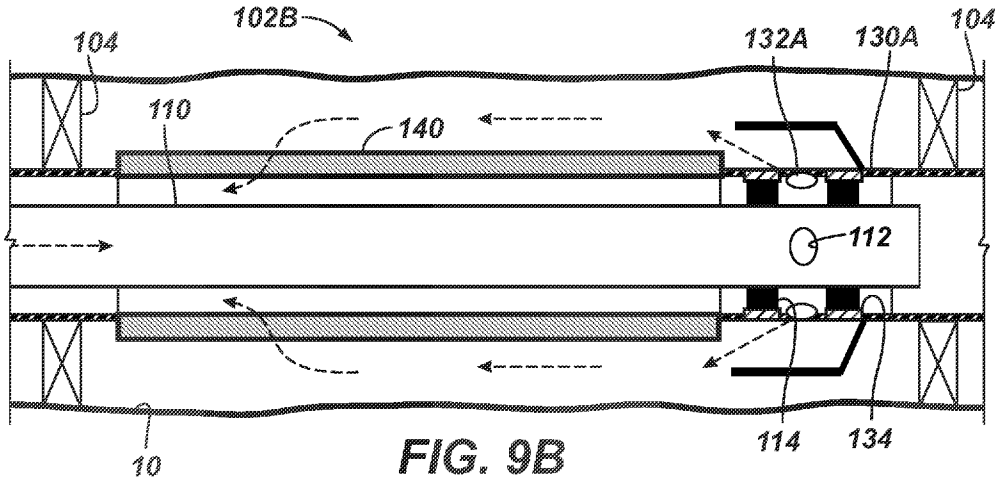

As an alternative shown in FIG. 9B, the next gravel pack section 102B can be more simplified and can have a ported housing 130 and screen section 140. Gravel packing here would involve toe-to-heel packing along the screen section 140 from the lower ported housing 130 until sandout.

These and other particular details of the toe-to-heel gravel packing operation are provided in the incorporated U.S. patent application Ser. No. 12/913,981 so that they are not repeated here.

C. Cementing Operation

Once gravel packing operations are complete, the assembly 100 is set to perform the cementing operation of the uphole liner 170. As shown previously in FIGS. 4C-4D, for example, the inner string 110 is moved uphole so that the ported end of the tool 110 leaves the gravel pack sections 102A-B and seats in the port collar 160A uphole of the last packer 104B (if present as in FIG. 4C) or uphole of the last screen section 140B (as in FIG. 4D). Operators then pump cement slurry down the inner string 110 so that the cement fills the annulus around the upper liner 170 to set it in the open borehole 10.

Figure 10A:
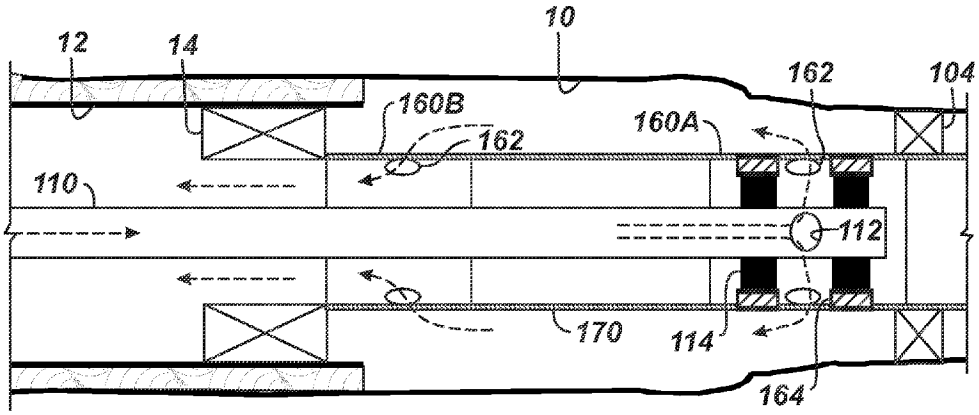
FIG. 10A shows a portion of the gravel pack assembly during cementing operations using one type of ported subassembly.
Figure 10B:
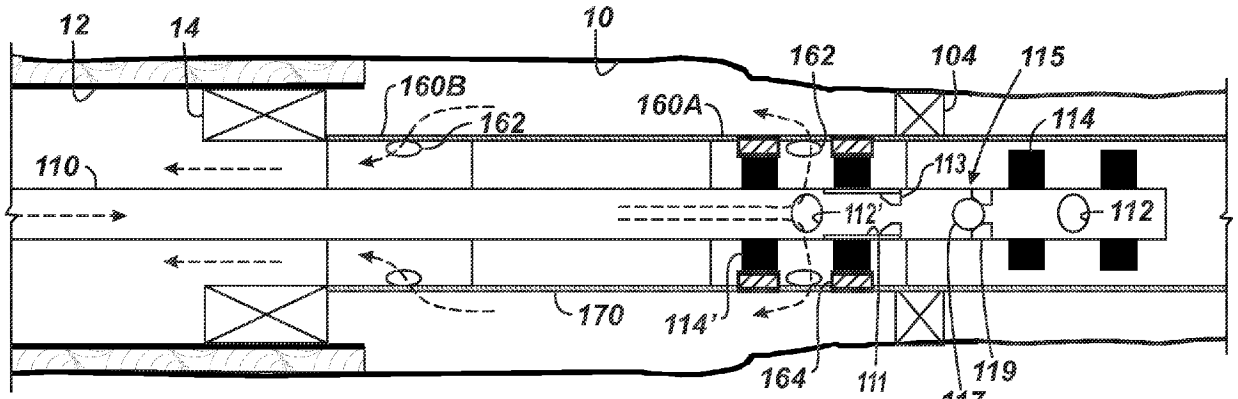
FIG. 10B shows a portion of the gravel pack assembly during cementing operations using another inner string arrangement.

One arrangement of port collars 160A-B on the liner 170 is shown in more detail in FIG. 10A. To communicate cement with the annulus, the outlet ports 112 at the end of the inner string 110 position in the lower port collar 160A, and the seals 114 engage the collar's seats 164 so the string's ports 112 communicates with the collar's ports 162. Cement slurry pumped down the inner string 110 exits the port collar 160A and fills the annulus around the liner 170 between liner hanger 14 and uppermost packer 104B (if used).

Meanwhile, as cementing is performed through the downhole collar 160A, the ports 162 in the uphole collar 160 disposed on the liner 170 downhole of the liner hanger 14 allow fluid returns from the borehole annulus around the liner 170 to pass into the space between the string 110 and the liner 170. The fluid returns can then pass uphole to the casing 12.

Although cement slurry may collect in the space between the inner string 110 and the liner 170, operators can clear any residual material with a circulating procedure after finishing the cementing operations.

As shown in FIG. 10A, the same ports 112 on the inner string 110 used for gravel packing can also be used for cementing in this arrangement. As an alternative shown in FIG. 10B, additional ports 112' and seals 114' on the inner string 110 can be used for cementing and are disposed a distance uphole of the ports 112 and seals 114 used for gravel packing. The dual sets of ports 112/112' and seals 114/114' may be useful if more or less ports 112' are needed for cementing than for gravel packing and if the cementing ports 112' need a different size than the gravel pack ports 112. Accordingly, the additional ports 112' and seals 114' may be the same as or different from those ports 112 and seals 114 used for gravel packing.

Either way, pumping of cement slurry down the inner string 110 is intended to exit the uphole ports 112' and enter the annulus around the liner 170 similar to the way described above. Because the gravel pack ports 112 are downhole of the cementing ports 112', the gravel pack ports 112 are isolated from fluid flow by a valve 115, which can be closed when cementing is performed. For this reason, the inner passage of the inner string 110 can be closed using a dropped ball 117 seated on a ball seat 119. The seated ball 117 prevents cementing slurry from passing further down the inner string 110 and diverts the cementing slurry out the cementing ports 112'.

Because the cementing ports 112' are uphole of the gravel pack ports 112, the cementing ports 112' should be closed when gravel packing is to be done. For this reason, the cementing ports 112' can be closed using a sleeve 111 with a ball seat 113. When closed, gravel pack slurry pumped down the inner string 110 would flow past the closed sleeve 111 to the gravel pack ports 112. When the ball 117 is dropped and fluid pressure is applied, the sleeve 111 moves and opens fluid flow to the cementing ports 112'.

Once the sleeve 111 moves, the ball 117 may remain in the sleeve's seat 113 or may pass through the seat 113. If the ball 117 remains in the sleeve's seat 113, the seated ball 117 can close of fluid flow past it and can divert the flow of cementing slurry to the cementing ports 112'. In this case, a seat 119 downhole would not be needed. However, the seat 113 on the sleeve 111 may be expandable and can release the ball 117 to engage the lower seat 119 if used.

In the previous arrangements (e.g., FIGS. 10A-10B), the port collars 160A-B merely had open ports 162, which would presumably remain open during the entire gravel packing and cementing operations. Depending on the implementation, having these open ports 162 on the liner 170 may be acceptable because fluid communication between the liner 170 and the borehole annulus may not be problematic. In other implementations, it may be preferred that the ports 162 on either one or both of these port collars 160A-B be able to close at least during gravel packing operations to prevent cross-flow between the liner 170 and borehole annulus.

Figure 11A:
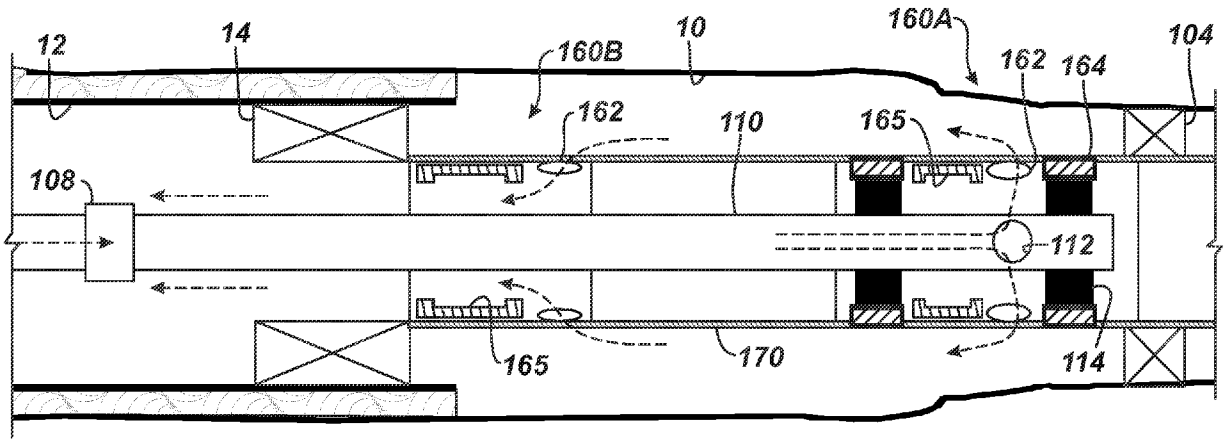
FIG. 11A shows other ported subassemblies of the gravel pack assembly for performing cementing operations with the inner string.

To that end, FIG. 11A shows another arrangement of port collars 160A-B for performing cementing operations. As before, the downhole port collar 160A is disposed uphole of the packing element 104 (if used) separating the liner annulus from the gravel pack sections (not shown). This collar 160A can have a valve 165, which can be opened to perform cementing operations, but closed during gravel packing. Similarly, the uphole port collar 160B can have a valve 165, which can be opened for cementing, but closed during gravel packing. Various types of valves 165 could be used, including, but not limited to, sliding sleeves, rotatable sleeves, rupture discs, and the like.

As one example, the collars 160A-B can use sliding sleeves for the valves 165 to expose the collar's side ports 162 for communicating with the borehole annulus. When closed, fluid returns from the gravel packing or other operations can be prevented from cross-flow between the annulus and liner 170. When opened, cement slurry can exit the open ports 162 of the lower collar 160A into the liner annulus, and fluid returns can enter from the liner's annulus and into the liner 170 through the uphole collar 160A.

These sleeves 165 can be opened using a shifting tool 108 disposed on the inner string 110 that opens the sleeves 165 as it is passed uphole with the string 110 through the collars 160A-B before cementing operations begin. As opposed to shifting sleeves, the sleeves 165 can be rotatable in which case a rotating tool 108 can be used.

Regardless of the type of sleeve used, the sleeves 165 can be closed at the end of cementing so production can be performed. Placement of the shifting tool 108 will depend on the particulars of the implementation and the length of the inner string 110 and assembly 100 so depicting of the shifting tool 108 at its location in FIG. 11A is only meant to be illustrative.

Figure 11B:
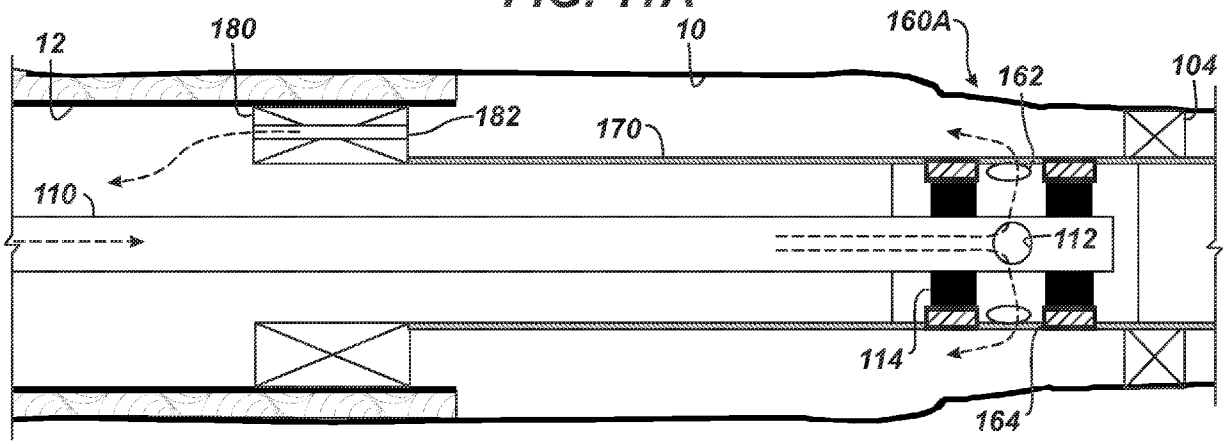
FIG. 11B shows the gravel pack assembly during cementing operations using a ported liner hanger.

Previous examples used an uphole port collar 160B for returns from the borehole annulus around the liner 170. As an alternative, FIG. 11B shows the gravel pack assembly 100 during cementing operations using a ported liner hanger 180. Rather than having the fluid returns pass from the annulus into the liner 170 through a port collar as described previously, the ported liner hanger 180 can have a bypass or passage 182 for returns. As shown in FIG. 11B, the inner string 110 is positioned in the downhole port collar 160A so cementing operations can be performed. Uphole, the ported liner hanger 180 with its bypass 182 allows fluid returns in the borehole 10 to enter the casing 12 during cementing.

The bypass 182 can take many forms. For example, the liner hanger 180 can have a gap between the liner hanger 180 and the casing 12 that acts as the bypass 182. Alternatively, the bypass 182 can be a port, orifice, or the like defined in the liner hanger 180. With the benefit of the present disclosure, one skilled in art that these and other configurations can be used for the ported liner hanger 180.

The foregoing description of preferred and other embodiments is not intended to limit or restrict the scope or applicability of the inventive concepts conceived of by the Applicants. It will be appreciated with the benefit of the present disclosure that elements of one embodiment can be combined with or exchanged for components of other embodiments disclosed herein. References have been made herein to use of the gravel pack assemblies in boreholes, such as open boreholes. In general, these boreholes can have any orientation, vertical, horizontal, or deviated. For example, a horizontal borehole may refer to any deviated section of a borehole defining an angle of 50-degrees or greater and even over 90-degrees relative to vertical.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A gravel pack-cementing apparatus for a borehole, the apparatus comprising:

a body being deployable in the borehole and having a body passage, a toe, and a heel, the body defining at least one gravel pack port toward the toe, a returns port toward the heel, and a cementing port between the at least one gravel pack port and the returns port, the body having at least one screen disposed between the at least one gravel pack port and the cementing port; and an inner string being movably deployable in the body passage and defining a string passage with at least one outlet port, the inner string moved to a first selective condition in the body passage sealing the at least one outlet port with the at least one gravel pack port and communicating gravel pack slurry from the string passage to the borehole from the at least one gravel pack port, the at least one screen receiving gravel pack returns as the gravel pack slurry travels in the borehole toward the heel and communicating the gravel pack returns from the borehole to the body passage, and the inner string moved to a second selective condition sealing the at least one outlet port with the cementing port and communicating cementing slurry from the string passage to the borehole from the at least one cementing port, the returns port receiving cementing returns as the cementing slurry travels in the borehole toward the heel and communicating the cementing returns from the borehole to the body passage.

2. The apparatus of claim 1, wherein the body comprises a liner disposed in the borehole from a liner hanger.

3. The apparatus of claim 2, wherein the liner defines the returns port and the cementing port.

4. The apparatus of claim 2, wherein the liner hanger defines the returns port.

5. The apparatus of claim 1, wherein the body comprises an isolating element disposed between the at least one screen and the cementing port and isolating uphole and downhole portions of the borehole.

6. The apparatus of claim 1, wherein the at least one outlet port of the inner string comprises a gravel pack outlet port and comprises a cementing outlet port disposed uphole of the gravel pack outlet port, and wherein the inner string comprises a valve selectively closing off fluid communication of the string passage with the gravel pack outlet port.

7. The apparatus of claim 6, wherein the valve comprises a sleeve movably disposed in the string passage and sliding open relative to the cementing outlet port in response to applied pressure on a dropped ball seated in the sliding sleeve.

8. The apparatus of claim 7, wherein the dropped ball prevents fluid communication in the string passage to the gravel pack outlet port.

9. The apparatus of claim 1, wherein at least one of the cementing and returns ports comprises a valve selectively opening fluid communication therethrough.

10. The apparatus of claim 9, wherein the valve comprises a sleeve disposed in the string passage and selectively movable relative to the at least one of the cementing and returns ports.

11. The apparatus of claim 10, wherein the inner string comprises a shifter mechanically moving the sleeve when disposed relative thereto.

12. The apparatus of claim 1, further comprising a first path device extending from the at least one gravel pack port and communicating gravel pack slurry from the at least one gravel pack port to the borehole.

13. The apparatus of claim 12, wherein the first path device delivers gravel pack slurry to the borehole toward the toe of the body.

14. The apparatus of claim 1, wherein the inner string in the first selective condition gravel packs the borehole from the toe to the heel.

15. The apparatus of claim 14, wherein the inner string in the second selective condition delivers cementing slurry from the toe to the heel of the body.

16. The apparatus of claim 1, wherein the body defines a toe port in the toe of the body, and wherein the inner string moved to a third selective condition in the body passage seals the at least one outlet port with the toe port and communicates the string passage with the borehole.

17. The apparatus of claim 16, wherein the toe port comprises a valve controlling communication through the toe port.

18. The apparatus of claim 1, wherein the at least one gravel pack port comprise first and second gravel pack ports, and wherein the at least one screen comprises a first screen disposed on the body between the first and second gravel pack ports and comprises a second screen disposed on the body uphole of the second gravel pack port.

19. The apparatus of claim 18, wherein in a first stage of the first selective condition, the at least one outlet port communicates gravel pack slurry to the borehole through the first gravel pack port; and wherein at least one of the first and second screens communicates the gravel pack returns from the borehole into the body passage.

20. The apparatus of claim 18, wherein in a second stage of the first selective condition, the at least one outlet port communicates gravel pack slurry to the borehole through an alternative path device connected to the second gravel pack port; and wherein the body comprises a bypass communicating gravel pack returns from the borehole into the body passage.

21. The apparatus of claim 1, comprising a plurality of arrangements of the at least one screen and the at least one gravel pack port disposed along the body between the toe and the cementing port.

22. The apparatus of claim 21, further comprising a plurality of isolating elements disposed on the body between the arrangements of the at least one screen and the at least one gravel pack port.

23. A gravel pack-cementing apparatus for a borehole, the apparatus comprising:

a body being deployable in the borehole and having a body passage, a toe, and a heel, the body defining at least one gravel pack port toward the toe, a returns port toward the heel, and a cementing port between the at least one gravel pack port and the returns port, the body having at least one screen disposed between the at least one gravel pack port and the cementing port; and an inner string being movably deployable in the body passage and defining a string passage with at least one outlet port, means for selectively gravel packing a first portion of the borehole around the at least one screen from toe to heel (a) with gravel pack slurry communicated from the string passage to the borehole from the at least one gravel pack port, and (b) with gravel pack returns communicated from the borehole to the body passage through the at least one screen as the gravel pack slurry travels in the borehole toward the heel, and means for selectively cementing a second portion of the borehole around the body from toe to heel (a) with cementing slurry communicated from the string passage to the borehole from the at least one cementing port, and (b) with cementing returns received from the borehole to the body passage through the returns port as the cementing slurry travels in the borehole toward the heel.

24. A gravel pack-cementing method for a borehole, the method comprising:

deploying an apparatus in the borehole, the apparatus having a toe and a heel;

deploying an inner string in a passage of the apparatus;

moving at least one outlet port of the inner string to at least one gravel pack port disposed between at least one screen and the toe on the apparatus;

gravel packing a first portion of the borehole around the apparatus from the toe to the heel by flowing gravel pack slurry through the at least one gravel pack port into the borehole and receiving gravel pack returns from the borehole to the body passage through the at least one screen as the gravel pack slurry travels in the borehole toward the heel;

moving the at least one outlet port of the inner string to a cementing port disposed between the at least one screen and a returns port toward the heel on the apparatus; and cementing a second portion of the borehole around the apparatus from the toe to the heel by flowing cementing slurry through the cementing port into the borehole and receiving cementing returns from the borehole to the body passage through the returns port as the cementing slurry travels in the borehole toward the heel.

25. The method of claim 24, wherein deploying the apparatus in the borehole comprises hanging a liner in the borehole from a liner hanger in a casing.

26. The method of claim 25, wherein the liner defines the returns port and the cementing port.

27. The method of claim 25, wherein the liner hanger defines the returns port.

28. The method of claim 24, further comprising isolating uphole and downhole portions of the borehole between the at least one screen and the cementing port.

29. The method of claim 24, wherein the at least one outlet port on the inner string comprises first and second outlet ports, and wherein gravel packing comprises flowing gravel packing slurry from the first outlet port, and wherein cementing comprises flowing cementing slurry from the second outlet port.

30. The method of claim 29, wherein flowing from the first and second outlet ports comprises selectively opening and closing fluid communication through the first and second outlet ports.

31. The method of claim 24, wherein flowing cementing slurry through the cementing port comprises selectively opening fluid communication through the cementing port.

32. The method of claim 24, wherein flowing cementing slurry through the cementing port comprises selectively opening fluid communication through the return port disposed between the cementing port and the heel of the body.

33. The method of claim 24, wherein gravel packing the first portion of the borehole around the apparatus comprises evacuating excess gravel packing slurry from the inner string into the borehole.

34. The method of claim 33, wherein evacuating the excess gravel packing slurry comprises evacuating the excess gravel packing slurry into the borehole toward the toe of the apparatus.

35. The method of claim 33, wherein evacuating the excess gravel packing slurry further comprises evacuating excess gravel packing slurry into the passage of the apparatus toward the toe.

36. The method of claim 33, further comprising flowing gravel packing returns from the borehole through a bypass in the apparatus.

37. A gravel pack-cementing method for a borehole, the method comprising:

deploying an apparatus in the borehole, the apparatus having a toe and a heel;

deploying an inner string in a passage of the apparatus, the inner string comprising first and second outlet ports;

moving the first outlet port of the inner string to at least one gravel pack port disposed between at least one screen and the toe on the apparatus;

gravel packing a first portion of the borehole around the apparatus from the toe to the heel by flowing gravel pack slurry through the at least one gravel pack port into the borehole;

moving the second outlet port of the inner string to a cementing port disposed between the at least one screen and the heel on the apparatus; and cementing a second portion of the borehole around the apparatus from the toe to the heel by flowing cementing slurry through the cementing port into the borehole.

38. The method of claim 37, wherein flowing from the first and second outlet ports comprises selectively opening and closing fluid communication through the first and second outlet ports.

* * * * *